US005816150A

United States Patent [19]

Sarda

[11] Patent Number: 5,816,150

[45] Date of Patent: Oct. 6, 1998

[54] DAMPENING UNITS OF OFFSET PRINTING PRESSES

[76] Inventor: Jean Lucien Sarda, 25, rue Pradier, F-75019, Paris, France

[21] Appl. No.: 832,120

[22] Filed: Apr. 3, 1997

Related U.S. Application Data

[63] Continuation of Ser. No. 454,323, filed as PCT/EP94/00542, Feb. 23, 1994 published as WO94/19189, Sep. 1, 1994, abandoned.

[30] Foreign Application Priority Data

Feb. 24, 1993 [FR] France ..... 93/02085

[51] Int. Cl.[6] ..... B41F 7/02; B41F 7/26

[52] U.S. Cl. ..... 101/142; 101/148; 101/450.1

[58] Field of Search ..... 101/148, 349, 101/350, 351, 352, 363, 132, 132.5, 136, 137, 140, 141, 142, 483, 450.1, 349.1, 350.1

[56] References Cited

FOREIGN PATENT DOCUMENTS 1557479 2/1969 France .
2 093 771 9/1982 United Kingdom .

*Primary Examiner*—J. Reed Fisher
*Attorney, Agent, or Firm*—Kinney & Lange, P.A.

[57] ABSTRACT

An improved offset printing press includes microcontrolled continuous film dampening units in combination with a water take-up roller, a dampening distributor roller, and a dampening form roller of a conventional offset printing press. The microcontrolled continuous film dampening units replace alternating feed dampening units of the conventional offset printing press. A removable module of the improved printing press includes a regulator roller, transfer roller, a dampening distributor roller, and liaison roller.

11 Claims, 9 Drawing Sheets

DAMPENING UNITS OF OFFSET PRINTING PRESSES

This is a continuation of application Ser. No. 08/454,323, filed as PCT/EP94/00542, Feb. 23, 1994 published as WO94/19189, Sep. 1, 1994 now abandoned.

BACKGROUND OF THE INVENTION

The invention described herein concerns the traditional dampening units of offset printing presses and relates to a procedure designed to transform the principles and mode of their operation. The purpose of these conversions is to endow dampening units modified according to the invention with characteristics and operational possibilities similar to those possessed by dampening units of recent design, which function according to principles and with a degree of precision that make it possible to obtain easily and instantly correct ratios of water to ink and close integration of the dampening and inking processes, the determining parameters which have enabled this method of printing to be developed. The principle characteristic of this conversion, the subject of the invention, is that the design and construction of the modified dampening units re-incorporates the main components and mechanisms of the original dampening unit, in order to retain their perfect geometry with respect to the other mechanisms of the press with which they work in harmony to perform correctly all the operations for dampening the printing plate. This procedure makes it possible to produce, at low cost, dampening units which are as totally integral to the press as the original dampening units of which they are the direct issue and to incorporate, directly and at reduced cost during manufacture of these presses, all the conversions which are the subject of the invention using means similar to those proposed for the application of the invention.

In its various forms, the invention makes it possible to choose the mode of continuous film dampening which is best suited to the types of printing press to be modified, sheet by sheet or continuous, as a function of their inking rate and the printing jobs that they carry out.

At present, the great majority of offset printing presses are equipped with conventional dampening units. These units, which are relatively primitive in design, perform their overall function of dampening an offset printing plate, but possess certain serious weaknesses in the mode and precision of their operation. Their dampening water feed is by alternating flow from a reservoir constituting a general supply. The rollers which convey the dampening water to the printing plate are covered with a sleeve of spongy fabric designed, once they are wetted, to carry a reserve of a considerable quantity of dampening water, reasonably well distributed throughout the sleeves, but in very approximate quantities. Given a reserve of this nature, it is a matter of trial and error to create an even film having a thickness which varies by an amount of the order of one or two microns, is precisely defined and can be controlled from one type of print to another. The absence of accurate means of control of the thickness of the water film, added to the excessively long response time of a dampening unit when the thickness is to be modified means that it is impossible to work with precision and it is difficult to achieve and maintain an acceptable ratio of dampening water to ink. Furthermore, this delicate equilibrium has to be re-established each time the press has been stopped, entailing a waste of both printed paper and time which is by no means negligible. At each change of ink colour and each long stoppage, the sleeved rollers become impregnated with greasy ink and have to be carefully cleaned. This operation, which is tedious for the printer, engenders considerable loss of time, involving as it does the dismantling and cleaning of these rollers and their re-fitting on the press. Another drawback of these sleeved rollers is that they disintegrate little by little and the fibres that they lose become stuck to the rollers of the inking unit and impair printing quality.

The consequence of all these negative aspects is that at present the majority of printing presses destined for the industrial production of work demanding optimum performance and a high and constant level of quality are almost all equipped with dampening units based on very different principles. These dampening units, known as continuous film dampeners, vary considerably in their design and method of operation, but all eliminate the outmoded, tedious and inaccurate aspects of the fabric-sleeved rollers. The different types of dampening units most commonly used and an outline of their mode of operation can be defined overall as follows:

continuous film dampening units on which the printing plate is dampened by a dampening forme roller fed directly with a thin film of dampening water. In this method of dampening, the emulsification of dampening water and ink essential for offset printing is effected by the printing plate and the dampening forme roller, which is inked by the printing plate, since the oleophilic properties of the rubber of which this roller is made are superior to its hydrophilic properties. These units are generally provided with a complementary function operating in parallel, enabling them to convey an additional supply of dampening water to the first dampening forme roller, thereby augmenting and accelerating the formation of the water-ink emulsion and providing the close interconnection between the inking and dampening processes. This complementary function also provides the possibility of cleaning the dampening unit by the use of the cleaning device of the inking unit.

In this type of dampening unit, the continuous film of dampening water is generally formed instantly by the action of two rollers rotating against each other under light pressure, at distinctly different relative speeds, fed with water taken up from the reservoir trough and conveyed for rolling by the water-duct roller. These two rollers, of which one is usually made of steel surfaced with matt-finish chrome, and the other coated with a micro-porous rubber, are driven jointly at speeds variable from that of the dampening roller of the printing plate. Modification of the ratio between these two velocities has an instant effect upon the thickness of the water film formed on the dampening roller and makes possible a precise and uniform regulation of the quantity of water delivered to the printing plate.

in another type of dampening unit, the printing plate is directly dampened and partially inked by means of a continuous film composed of a fine emulsion of dampening water and ink, deposited on the printing plate by the dampening forme roller. This micro-emulsion of water in ink is created directly and continuously by rolling the two constituents between rollers coated alternately with soft and hard oleophilic materials (such as rubber and hard plastic of the polyamide type). The rollers are first inked and then dampened. The number of dampening unit rollers can be limited according to the nature and hardness of the rubbers used for the coatings and their contact pressure. A perfectly uniform emulsion is created with a few revolutions of the press and is sustained very evenly as printing proceeds by an evenly balanced supply of ink from the inking unit via the printing plate and the dampening roller where an alternating movement of ink and water between the dampening unit and the inking unit is established instantly and reaches perfect stability, directly achieving integration of the dampening and inking operations. The quality of the emulsion is improved by choosing additives for the dampening water which make it possible to limit the proportion of water retained in the emulsion, but as the mechanical action executed during rolling is extremely efficient, even a hard water (pH 30) without additives will permit printing of acceptable quality.

Inking of these dampening units is most frequently performed with a spatula, and cleaning is carried out with the use of the cleaning device of the inking unit to which it is temporarily linked by means of the printing plate. This procedure presents certain drawbacks, since the printing plate is partially destroyed by the cleaning agents and after cleaning it is necessary to clean the edges of the printing plate and of the plate cylinder which have been loaded with liquefied ink by the cleaning agents. Another disadvantage of these dampening units is that they do not possess a complementary system for the occasional conveyance of a small additional quantity of water-ink emulsion to the first inking forme roller, a function which is useful where the printing demands very intense loads and large areas of ink.

other dampening units, less professional, convey the water directly to the first inking forme roller, but fail to take advantage of the barrier provided by the printing plate to avoid the risk of excessive application of emulsion to the whole inking unit, which engenders loss of density and vigour in the impression.

Every manufacturer has his own design of dampening unit, varying according to the size of the equipment being manufactured.

These various basic principles for the dampening of the printing plate by continuous film make it possible to reduce dampening to a minimum, thereby improving the vigour and definition of the impression, while greatly reducing the risk of accidental ink transfer between the sheets when they are stacked in the delivery pile.

Furthermore, these continuous direct acting units do not incorporate sleeved rollers, which limits evaporation of the dampening water and so makes it possible, for some kinds of work, to add isopropyl alcohol to the water to lower its surface tension and improve its film forming properties, thereby reducing to a minimum the thickness of the film applied to the plate.

The precision of function of these different units in operation, their rapid response times, the high quality of the impression they produce and their ease of use are all factors contributing to their wide distribution.

In consideration of this fact, some manufacturers of accessories for printing presses have designed continuous film dampening units based on the same operating principles as those supplied as original components during the manufacture of presses. These units, which are completely autonomous, possess all the functions required for dampening of the printing plate. Such a unit is independent in operation, and is installed in place of the original, conventional dampening unit. It possesses its own body, which incorporates all the mechanical components and control mechanisms. However, the installation of these independent units is a long job demanding profound modifications to the mechanism of the press and rendering the conventional dampening unit unserviceable by the removal of its essential components. These adaptations are a delicate operation, since it is difficult with an added unit to ensure, and to maintain in a reliable manner, perfect geometry and alignment of the main components of these units relative to the plate cylinder and the inking forme roller of the press, components with which they nevertheless have to operate in perfect and precise harmony if the modified press is to function properly. Furthermore, the fact that the controls of the replacement unit are not fully integrated with the controls for automatic operation of the printing cycle, which are normally operated with a single lever, obliges the printer to change his working habits.

SUMMARY OF THE INVENTION

The invention described here aims to remedy the weaknesses of conventional dampening units and provide an improved general alternative solution for their replacement. It is characterized by the conversion of a conventional dampening unit into a continuous film dampening unit, specially designed from the starting point of the main components and mechanisms of the conventional unit which it utilises for its construction, installation and operation. This procedure offers a number of important and clear advantages which may be summarized overall as follows:

For its construction, installation and operation, the continuous unit benefits from the perfect geometry of the press of which, as far as its principal mechanisms are concerned, it becomes an integral part in the same way as the original dampening unit.

The main basic components of the continuous dampening unit are fitted and driven in place of those of the original unit and may utilise the same or different functions according to the type and design of press. Positioning the basic components of the continuous unit by means of the same mountings and drive mechanisms of the press ensures perfect geometry and alignment with respect to those parts of the press with which they have to work in unison. Assurance of the reliability of the continuous unit is also provided by use of the drive mechanisms of the press to drive the main components of the resulting continuous unit, due to their strength and quality of manufacture.

The massive, stable body of the press locates and receives, by means of attachment created from active components of the conventional unit, all the supplementary components required for the functioning of the converted unit.

The printer retains his working habits unchanged, with his usual control lever.

The cost of these units, thanks to the incorporation of a good number of the components of the conventional dampening unit, is incomparably lower than that of a supplementary, independent unit.

The conversion of the conventional dampening unit into a continuous dampening unit is simple and quick, without any machining or drilling of holes in the press, a very advantageous aspect for the printer, since he knows that, in case of a breakdown, he can himself restore his original dampening unit in a very short time while waiting for a repair to be carried out.

BRIEF DESCRIPTION OF THE DRAWINGS

By way of illustration, there follows, not an exhaustive list, but a description of four examples of ways of converting original dampening units using sleeved rollers into continuous film dampening units. Two of these examples concern a method of dampening in which the printing plate is dampened with a water-ink emulsion, and the other two methods in which the plate is dampened by continuous film. These different examples bring improvements in use or in cost of installation by comparison with the techniques usually applied.. In order that the existing means employed to realize the invention in its different forms may be fully understood, the mode of operation of a conventional dampening unit before conversion is first described with the aid of three diagrams. FIGS. 1, 2 and 3 represent a conventional dampening unit on an offset printing press. FIG. 1 shows a diagrammatic representation of the roller used for direct dampening of the printing plate together with the water feed system. The reservoir 1 has no air inlet, so feed to the trough 2 occurs as a function of consumption by the press, the water level never rising above the bottom of the tap 3 which thus acts as a regulator of the level of the dampening solution. The water take-up roller 4 is partially immersed in the dampening water contained in the trough 2 and the general mechanism of the press periodically rotates it by a varying amount, according to the quantity of water required for correct dampening of the printing plate. The water duct roller 5, supported at each end on the bell cranks 6 tilting on the pivots 7, oscillates with a cyclical movement imparted by the mechanism of the press. At each printing cycle, this movement brings it into contact alternately with the water take-up roller 4, where it picks up the water required for the impression, then with the dampening distributor roller 8 moving with an axial motion, where it deposits the water. The dampening forme roller 9 rotates in permanent contact with the dampening distributor roller 8 to take up its moisture, part of which it then passes on to the other dampening forme roller 10 by way of the degreasing roller 11. The water duct roller 5 and the two dampening forme rollers 9 and 10 are covered with a sleeve of porous molleton which acts as a water reserve supplied by the dampening distributor roller 8. The printing plate fixed on to the plate cylinder 12 is thus dampened as soon as it is brought into contact with the dampening forme rollers 9 and 10 on the decision of the press operator, the levers 13 and 14 pivoting about the axles 15 and 16. After this action has been taken to dampen the printing plate, the inking forme rollers 17, 18, 19 and 20, in contact with the ink distributor rollers 21 and 22, can begin to ink the printing plate on the plate cylinder 12 to enable printing to start.

FIG. 2 and its profile view FIG. 3 show in greater detail the mechanical means employed to hold in place, adjust and move the rollers constituting the dampening unit of a traditional press of one of the most widely used types. The trough 2 FIG. 2 is suspended from the cross member 23 which lends rigidity to the side panels 25 of the body of the press by means of the hooks 24 and two wing nuts which are omitted from the drawing in the interests of clarity. The trough 2 can be removed very quickly by undoing these two nuts. The water take-up roller 4 is rotated by the half-shaft 26 FIG. 3 carrying at one end a device for inducing rotation actuated by the general mechanism of the press. At the other end, the half-shaft 26 carries a half clutch 27 and a bore into which is introduced the axle of the water take-up roller 4. The latter carries the second clutch half 28, engagement of which in the half clutch 27 induces rotation of the assembly. At the other end, the axle of the water take-up roller 4 is engaged in a sliding half-shaft 29 kept pressed against the circlip 30 by the return spring 31. The lug 32 keeps the return spring 31 under constant pressure thus ensuring that the water take-up roller 4 is kept in place. The collar 33, equipped with a needle roller free-wheel 34 allows for the possibility of manual rotation of the water take-up roller 4 by means of the lever 35. This mechanical arrangement makes possible very rapid dismantling of the water take-up roller 4 by pressure on the sliding half-shaft 29 which compresses the return spring 31 thus permitting disengagement of the axle of the water take-up roller 4. The water duct roller 5 with its molleton sleeve 5A carries at each end a ball bearing 36 located between two fixed pins 37 and 38 FIG. 2 and one sliding pin 39 arranged in a triangle in the bell cranks 6. Operation of the buttons 40 FIG. 3 frees the ball bearings 36 and so permits removal of the water duct roller 5. The same mechanism is used to retain the dampening forme rollers 9 and 10 FIG. 2 supported by the levers 14 and 13, the latter being associated with the adjusting counter-lever 13A in which are engaged the fixed pins 37 and 38 and the sliding pin 39. These mechanisms permit rapid and easy removal of the water duct roller 5 and the dampening forme rollers 9 and 10. It will have been necessary first to remove the degreasing roller 11. This is normally held in place against the dampening forme rollers 9 and 10 by the action, at each end, of the pressure springs 41 supported by the journals 42. These pivot in the levers 43 which are tilted manually on the stub axles 44 by means of the handles 45, their movement being limited by the stops 46 and 47. The slide-bars 48 guide the pressure springs 41 and are mounted on the fixed axle 11A of the degreasing roller 11 by means of the slide bar heads 49 which have a centring vee at their tip. The degreasing roller 11 rotates about the fixed axle 11A on ball bearings. Tilting the levers 43 by means of the handles 45 thus quickly and easily disengages the dampening forme rollers 9 and 10 to permit their removal. This operation is performed daily and generally several times a day at each change of printing ink colour.

By way of example, there follows, with references to the attached drawings, a description, which is not an exhaustive list, of the means employed to convert an alternating feed dampening unit to continuous feed.

The first example described with reference to attached drawings FIGS. 5 and 6 concerns a dampening unit having the following characteristics and functions:

continuous dampening of the printing plate with a water-ink emulsion, automatic pre-inking of the dampening unit by the press, automatic washing of the dampening unit by means of the washing system of the press, optional, supplementary application of emulsion to the first inking forme roller, a useful function where the print includes very large inked areas.

This first example includes a characteristic supplementary to those of the most frequently used units that provide continuous dampening of the printing plate by water-ink emulsion: this provides for the possibility of equipping the presses, according to their type and their printing speed, either with a water take-up roller and water duct roller made of plastic in the usual way or, according to the allowable cost for conversion of these presses, with water take-up rollers and water duct rollers made of almost pure copper or a similar material possessing oleophilic and hydrophilic properties which engender a much finer water-ink emulsion, containing a lower proportion of water and making it possible to prevent excess ink from accumulating on the water take-up roller 4. Furthermore, heat loss from copper being very much more rapid than from plastics, this allows the emulsion and the ink on the printing plate and forme rollers to be maintained in a less fluid state, greatly improving printing quality.

In addition, cleaning of copper components is much faster and greatly superior to that of plastic components and for offset presses printing continuously at high speeds, such as rotary or similar, copper is the unhesitating choice.

Figure 7A:
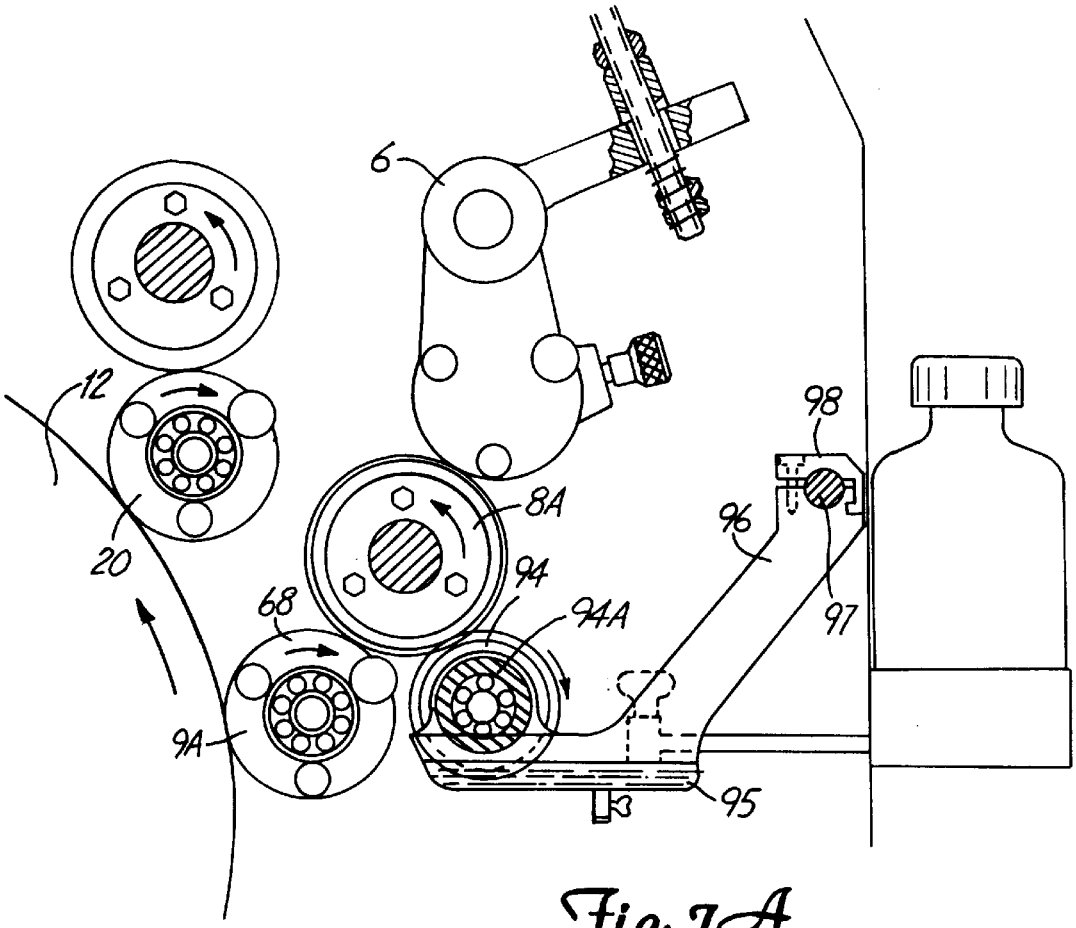
FIG. 7A is a front elevational view and 7B is a side sectional view of another embodiment of the removable module according to the present invention.
Figure 7B:
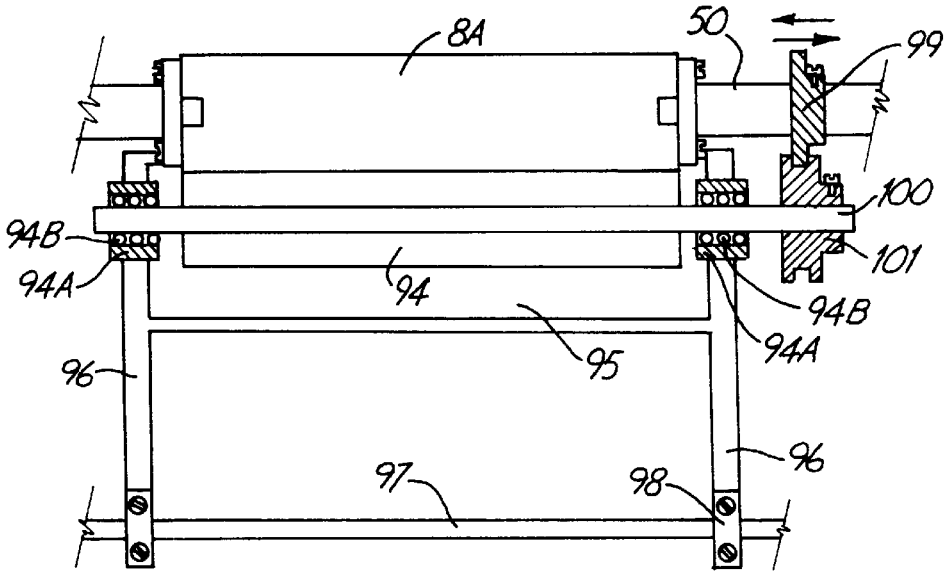

The second example, FIG. 7, relates to a dampening unit operating on the same principle as the first but greatly simplified, so that:

it requires manual pre-inking by spatula it requires manual cleaning there is no facility for supplementary inking of the first inking forme roller.

Figure 8:
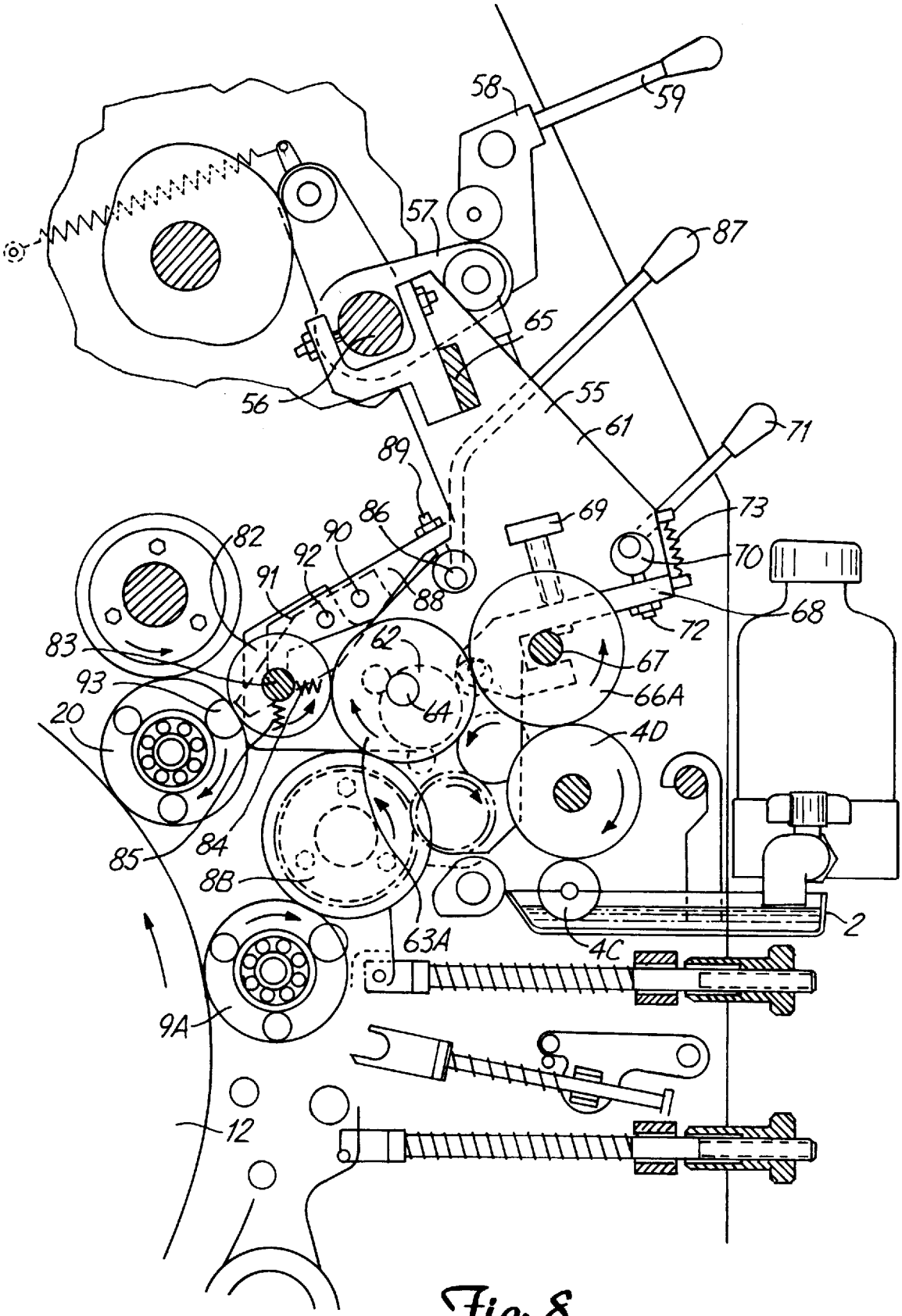
FIG. 8 is a side elevational view of another embodiment of the removable module dampening unit according to the present invention.

The third example, FIG. 8, relates to a dampening unit comprising all the functions of the first example from which it derives, but is characterized by the fact that the printing plate is not dampened with a water-ink emulsion, but with a microfilm of water. This variation is obtained chiefly by the use of different coating materials, possessing either oleophilic properties, such as copper, polyamide (Rilsan) or others for the first and second examples, or hydrophilic properties in the third and fourth examples, such as hard chrome or microporous ceramic, or rubber rollers of types already known, which themselves possess properties which may be oleophilic, hydrophilic or mixed.

In the third example and according to this form of the invention, bearing in mind that at a given speed hydrophilic or mixed materials convey much more water to the printing plate than is conveyed by emulsion, where an equilibrium between water and ink establishes itself naturally, the quantity of water conveyed to the unit is controlled and regulated by using the original variable speed drive mechanism of the water take-up roller and instantly creating a small reserve of water by the assembly of rubber transfer rollers which have hydrophilic properties and a microporous surface texture obtained by grinding with coarse-grained, semi hard grinding wheels, so that the printing plate is supplied with a continuous microfilm.

Figure 9:
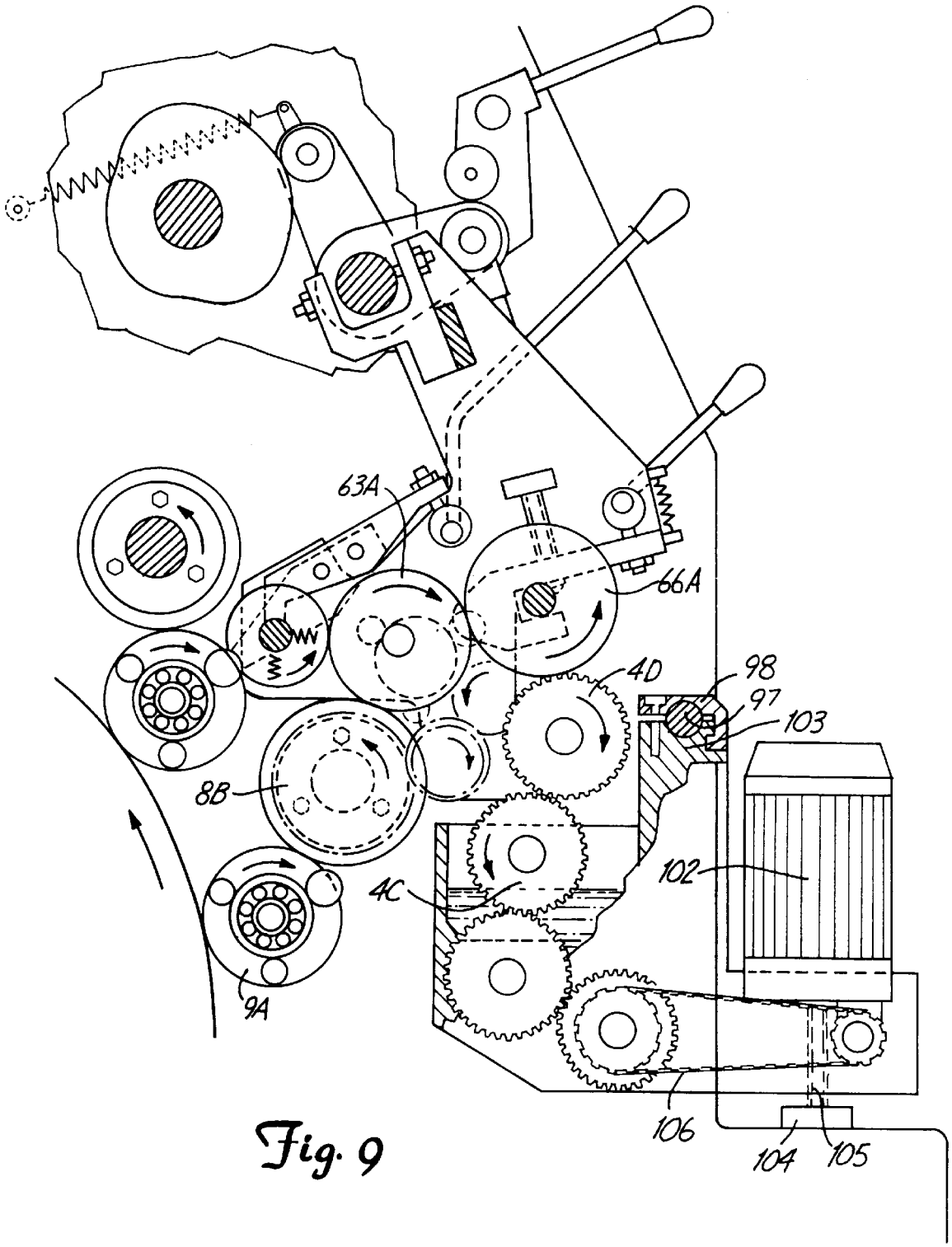
FIG. 9 is a side elevational view of another embodiment of the removable module according to the present invention.

The fourth example FIG. 9 relates to a device similar to the third, but obtains the quantity of water by varying the relative rotation speeds of the water take-up roller 4C and the drying roller 4D with respect to the transfer roller 66A turning at the speed of the press. This procedure permits centralized adjustment of the controls of the motor or motors driving these two rollers at variable speeds and is of particular interest in the case of multi-colour presses comprising successive printing units in line.

Figure 1:
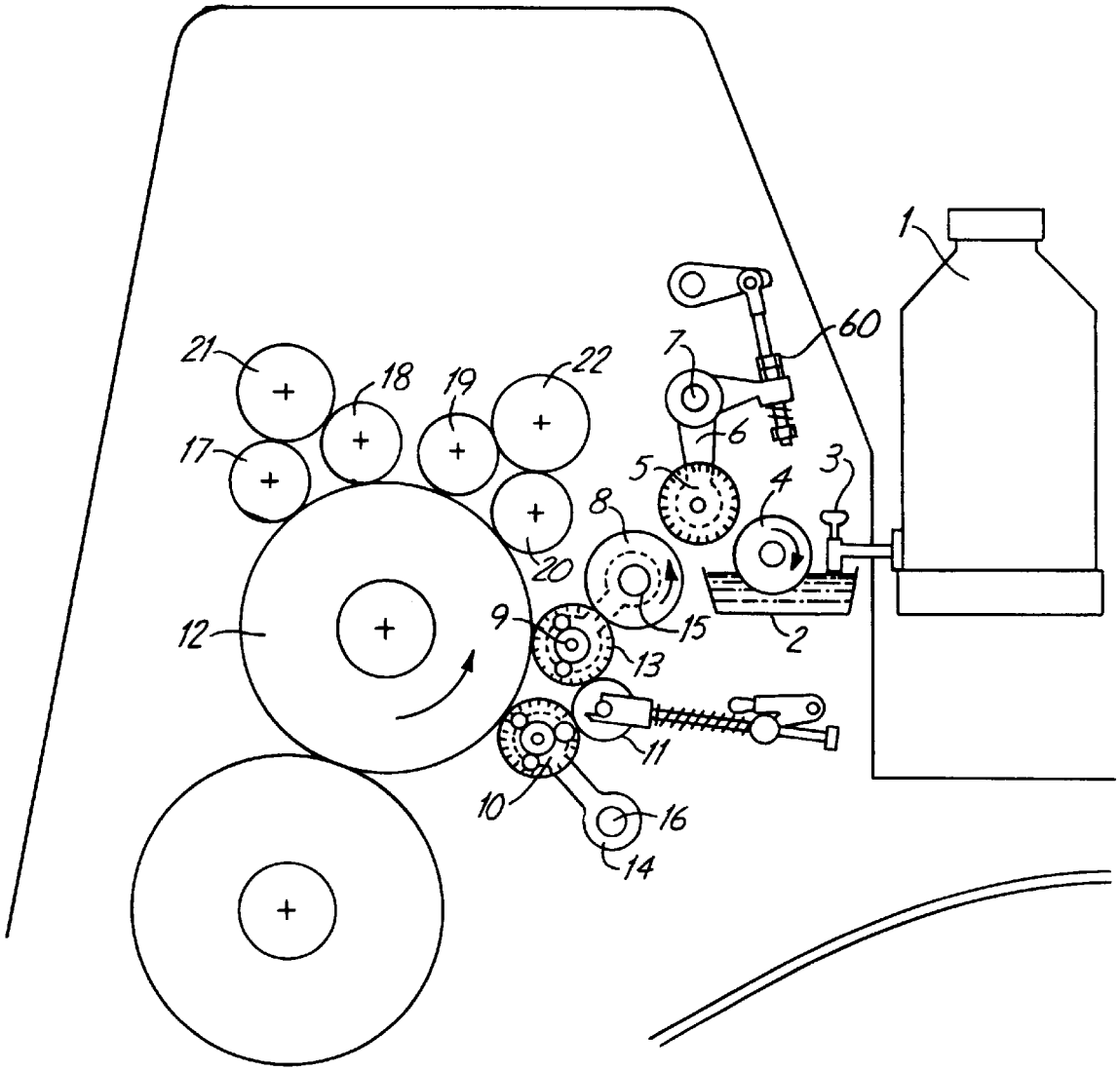
FIG. 1 shows a front elevational diagrammatic representation of a conventional dampening unit on an offset printing press of the prior art.
Figure 3:
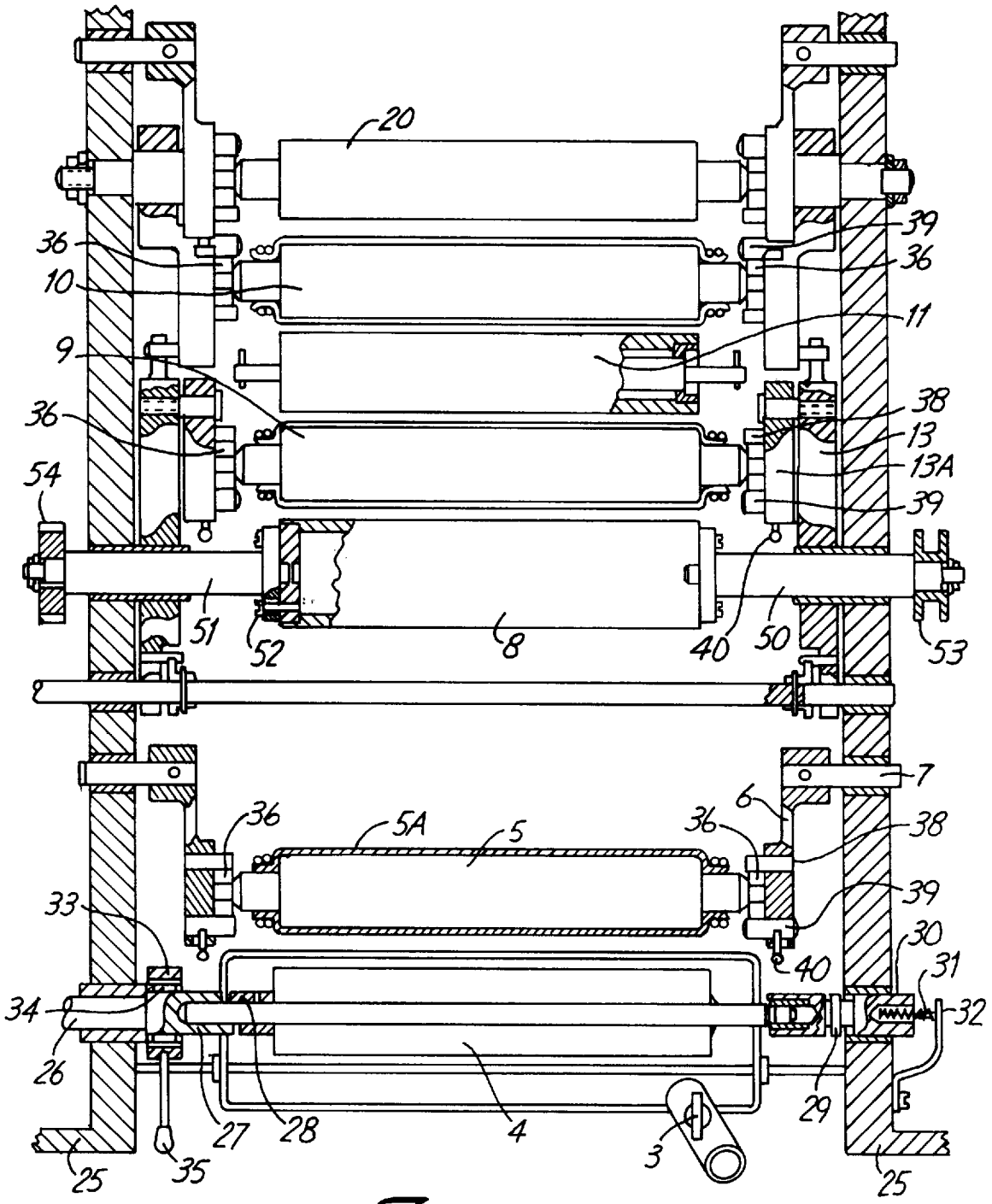
FIG. 3 is a side sectional view of FIG. 2 showing the mechanical means employed to hold in place, adjust and move the rollers constituting the dampening unit shown in FIG. 1.
Figure 4:
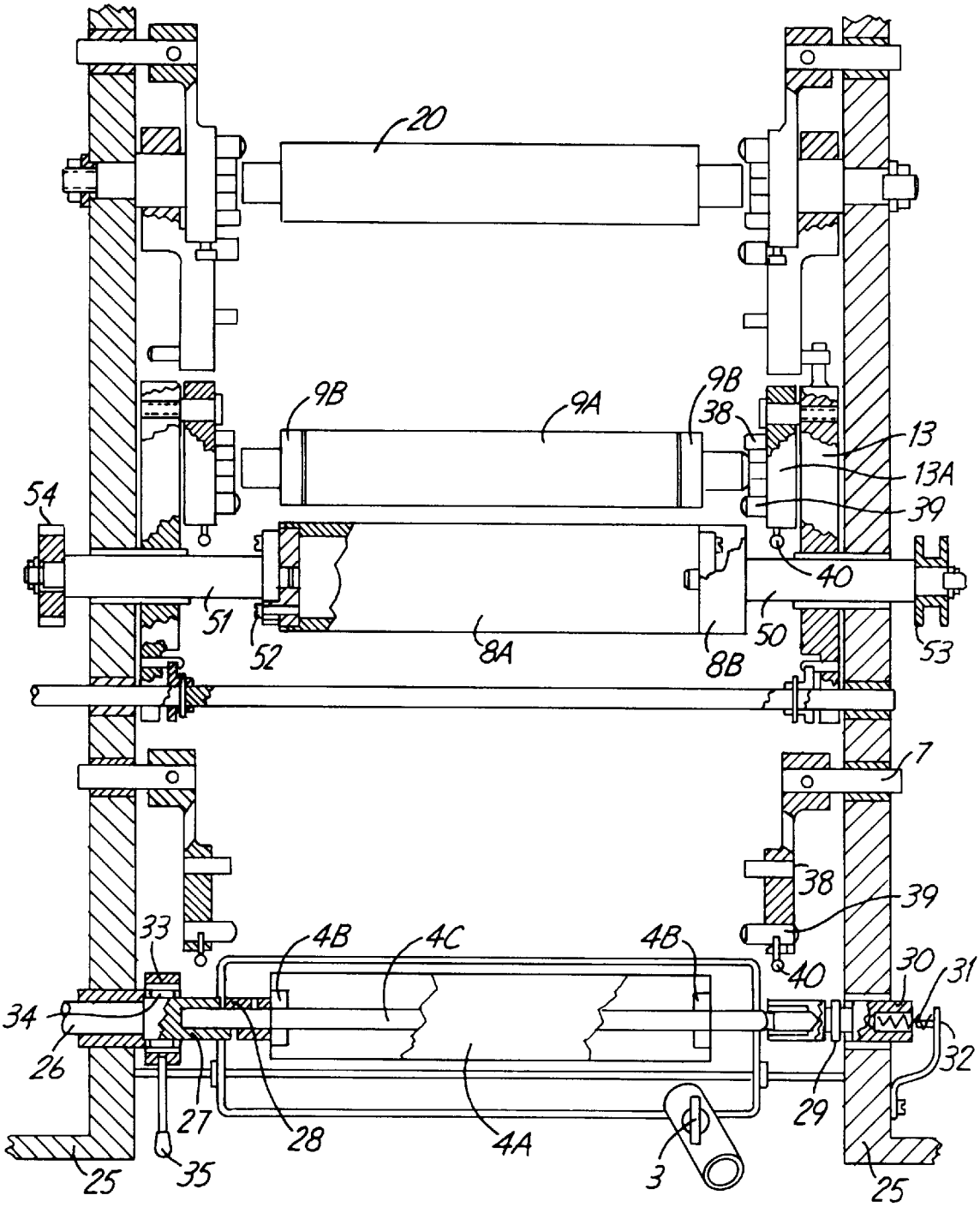
FIG. 4 is a side sectional view showing a printing press ready to receive a removable module according to the present invention.
Figure 5:
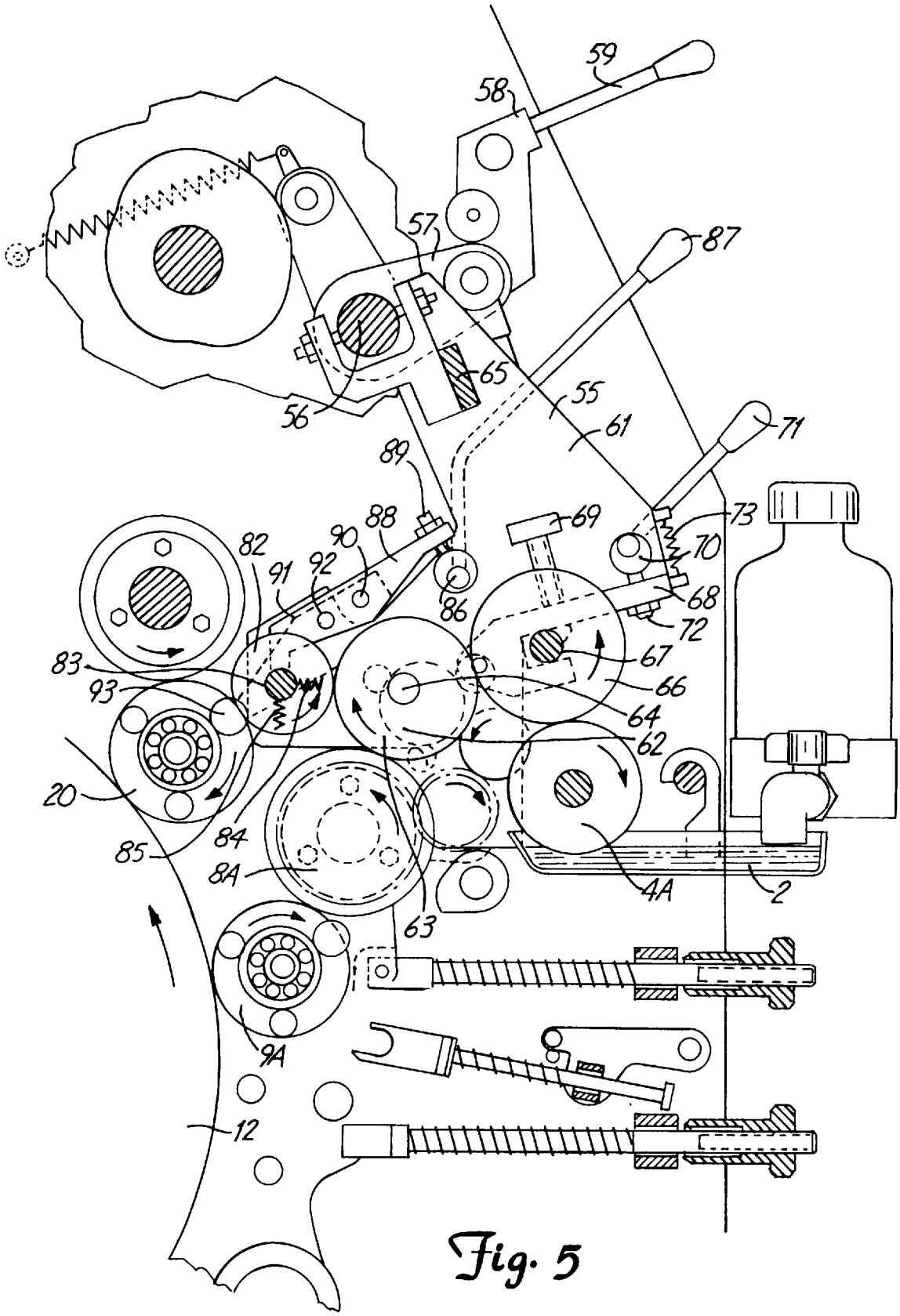
FIG. 5 shows a front elevational diagrammatic representation of the removable module according to the present invention inserted onto the printing press of FIG. 4.
Figure 6:
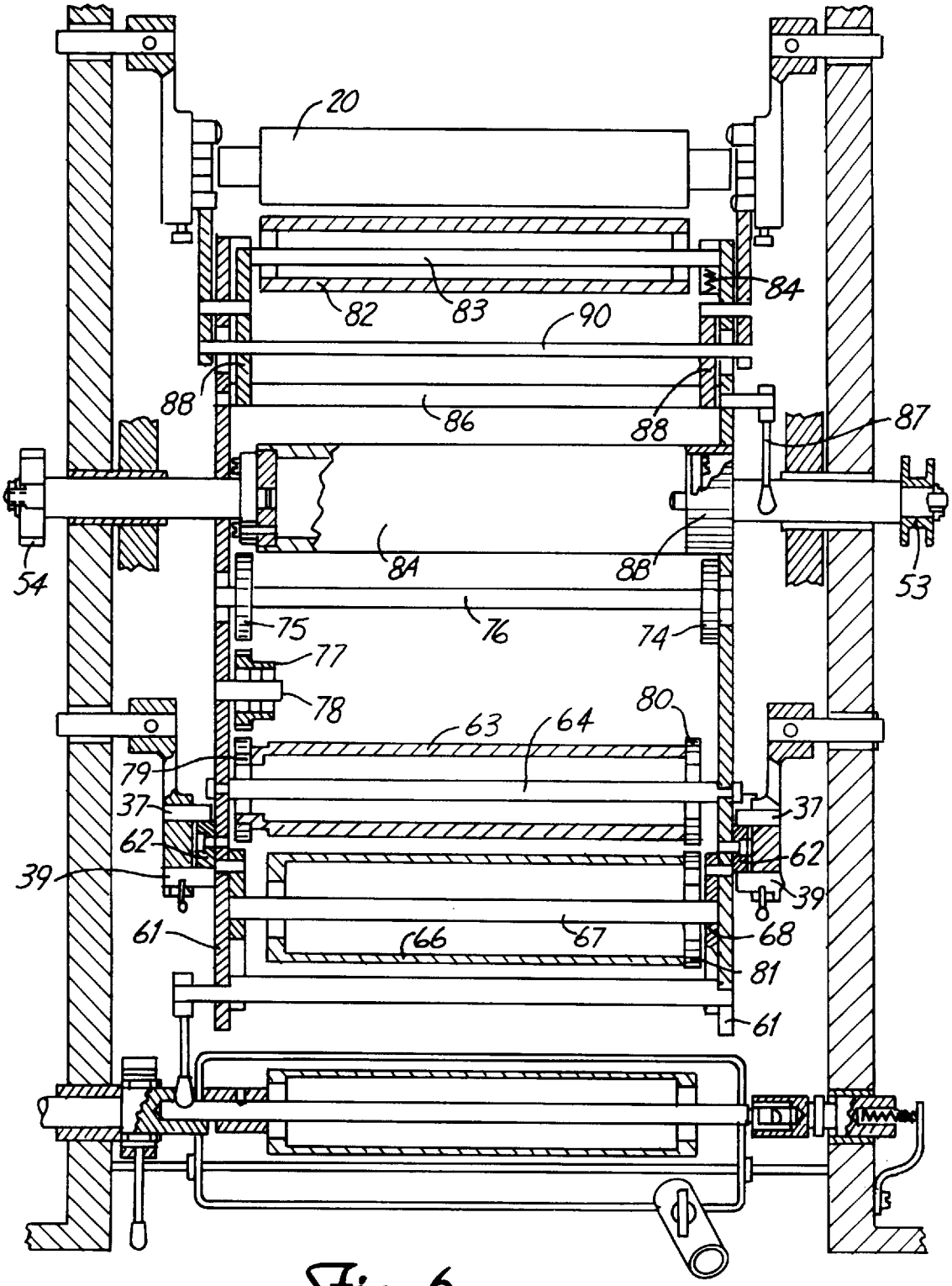
FIG. 6 is a side sectional view of the printing press and module of FIG. 5.

FIG. 4 shows the printing press ready to receive its removable module FIG. 5 to complement the dampening unit. The dampening forme roller 9 FIG. 3 covered with a porous molleton sleeve, the chrome dampening distributor roller 8 and the water take-up roller 4 have been replaced: in the first example:

by a rubber dampening forme roller 9A of the same diameter, possessing oleophilic and hydrophilic properties, each end of which carries a band 9B composed of a much harder rubber (hardness about twenty-five Shore for the roller and sixty-six Shore for the bands) designed to press against and work together with the bands of the plate cylinder 12 FIG. 1.

by a dampening distributor roller 8A of the same diameter as the original one, having a surface coating of hard copper of five to six tenths of a millimetre thickness, bearing at one end a gear wheel 8B designed to transmit its motion to the assembly of other rollers of the converted dampening unit.

by a water take-up roller 4A, copper clad, also of the same diameter, mounted free to rotate on its axle by means of the bearings 4B. Its axle is itself driven by the same cyclical mechanism as the original water take-up roller 4 FIG. 3, by the mechanism of the press without driving the water take-up roller 4A. Whatever the design and whatever the mechanical configuration adopted for the application of the invention, the dampening distributor roller 8A FIG. 4 and the dampening forme roller 9A retain their original function, so as to guarantee perfect geometry with respect to the plate cylinder 12 FIG. 3 and to conserve also the cyclical automatic printing functions regarding the making and breaking of contact between the printing plate and the dampening forme roller 9A.

In examples one, three and four, the rollers are driven positively by gears to permit automatic washing of the dampening unit and avoid the necessity for the operator to take precautions with regard to the distribution of the cleaning solvents, as too much greasy solvent can lead to slippage between the rollers of the dampening unit and render the cleaning operation difficult. However, these gears do not contribute to the functioning of the dampening unit. FIGS. 5 and 6 show sectional and top views of an example of a dampening unit which gives very good results and is very practical to use for the operator of the press.

The removable module 55 FIG. 5 can be installed in and removed from the press effortlessly and in a few seconds, giving easy access to the other elements of the press. It comprises all the supplementary mechanisms of the dampening unit. Its location and detachable fixing to the press are effected occupying the position of the original water duct roller 5 FIG. 2 and using the control shaft of the duct roller 56 for support. To do this, the duct roller control must be locked, which is done by moving the cam 58 FIG. 5 by means of the lever 59 to push back the return lever 57. Adjustment can be carried out by means of the nuts 60 FIG. 2.

Figure 2:
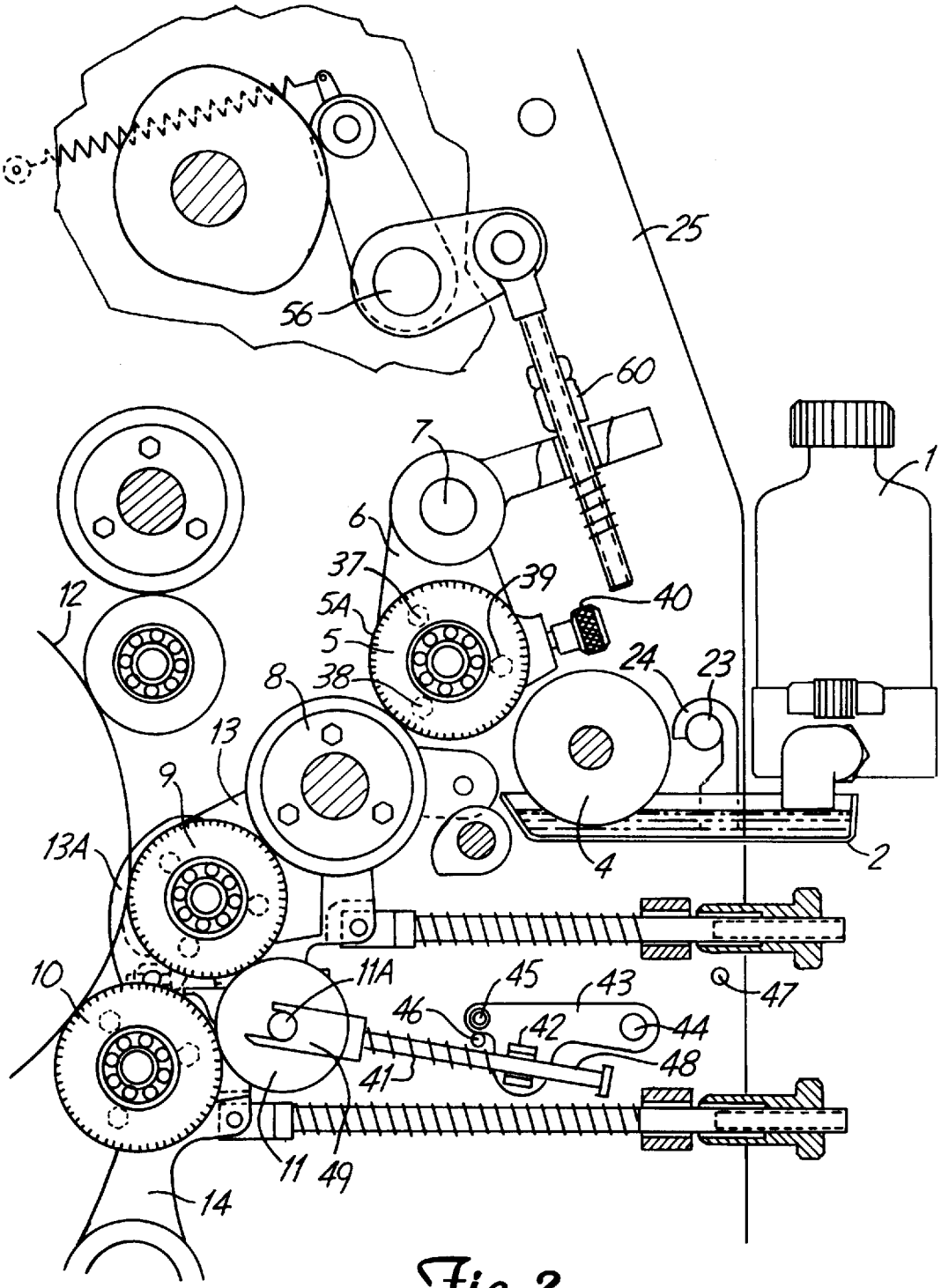
FIG. 2 shows in greater detail the rollers used in the conventional dampening unit of FIG. 1.

The removable module 55 FIG. 5 is composed of two side plates 61 cross-braced and located by two centring pieces 62 which occupy the positions of the bearings of the original water duct roller 5 FIG. 2, captive between the fixed pins 37 and 38 and the sliding pins 39. The rubber-covered transfer roller 63 FIG. 5 is mounted turning on a fixed axle 64 which acts as a cross- brace, as does the cross-member 65 between the two side plates 61.

Adjustment of the touch of the hard copper-covered dampening distributor roller 8A against the transfer roller 63 is performed by the nuts 60 FIG. 2 when the touch of the different rollers is being adjusted. A regulator roller 66 effects the liaison between the water take-up roller 4A and the transfer roller 63. It is mounted turning on a fixed shaft 67, which is itself mounted on two oscillating supports 68 and subjected to pressure by means of the screws 69 maintaining it in constant contact with the transfer roller 63. Its application to the water take-up roller 4A is effected by the action of the eccentric 70 moved by the lever 71 acting on the oscillating support 68 through the adjustment screw 72. Its contact with the water take-up roller 4A is broken manually by rotating the eccentric 70, releasing the oscillating supports 68 which are withdrawn by the springs 73. The rotation of the transfer and regulator rollers 63 FIG. 6 and 66 is driven by a gear train originating at the dampening distributor roller 8A. The first gear wheel 8B is smaller in diameter than the exterior of the dampening distributor roller 8A so as to avoid bottoming on the bands 9B FIG. 4 of the dampening forme roller 9A situated just opposite. To compensate for the difference in speed resulting from this inequality, a set of pinions 74 and 75 FIG. 6, keyed on to the same rotating shaft 76, re- establishes the proper speed ratio. Hence an intermediate pinion 77, mounted rotating on a fixed shaft 78, transmits the rotation at the right speed and in the right direction to the transfer roller 63 by means of the pinion 79 fixed to the latter. The regulator roller 66 is similarly driven through the pinion 81 fixed to it and the pinion 80 fixed to the transfer roller 63.

Finally, a connecting roller 82 brings the transfer roller 63 into contact with the inking forme roller 20. It is mounted turning on a fixed shaft 83. This maintains it under permanent pressure against the inking forme roller 20 by the action of two spring thrusters 84. Two more spring thrusters 85 FIG. 5 unstick it vertically upwards, thereby keeping it separate from the transfer roller 63. The two are brought into contact by manual action on an eccentric 86 FIG. 6, operated through the two levers 87 acting on two rockers 88. The screws 89 FIG. 5 regulate the pressure. In order to permit the connecting roller 82 to follow the movement of the inking forme roller 20 when it pivots during the operation of making contact with the printing plate, the pivots 90 of the rocker 88 are mounted on two levers 91 turning on the pivots 92 and supported on the locating pins 93 of the inking forme roller 20. The connecting roller 82 effects either the pre-inking or the washing of the dampening unit by way of the inking unit, or can obtain a "frilly" printing effect by conveying additional water to the first inking forme roller to intensify the water-ink emulsion. The emulsion and its regulation are obtained between the copper-covered water take-up roller 4A and the rubber-covered regulator roller 66.

Views A and B of FIG. 7 represent, in a simplified form of the invention, an example of a water-ink emulsion continuous film dampening unit of very low cost which does not offer all the functional advantages of the preceding example, but nevertheless gives vastly better results than those obtained with the original unit.

In this configuration, the original dampening distributor roller 8 FIG. 1 is replaced by the dampening distributor roller 8A FIG. 7 View A, which is mechanically identical but copper-covered. The rubber-covered water take-up roller 94 FIG. 7 View A is driven by friction through the dampening distributor roller 8A and turns in the bearings 94A equipping the trough 95, which is supported by two side members 96 fixed to the cross-member 97 by means of the removable clamping lugs 98. The emulsion is formed between the rubber-covered water take-up roller 94 and the dampening distributor roller 8A which have previously been inked. The dampening distributor roller 8A performs the functions of a regulator roller and of transferring the emulsion to the dampening forme roller 9A. The axial displacement movement of the dampening distributor roller 8A as it turns, known as "reciprocation", ensures perfect distribution of the emulsion on the dampening forme roller 9A. Should the dampening forme roller 9A be laterally fixed, the unit would be unable to work, as there would be rapid accumulation due to excess water. This excess originates either from the end surfaces of the rubber-covered water take-up roller 94, if this is shorter than the dampening distributor roller 8A, length of reciprocation included, or it the dampening forme roller 9A is the same length as the dampening distributor roller 8A or longer, the latter, in its axial movement, loses contact with part of the rubber-covered water take-up roller 94 on which the water, no longer regulated, spreads out under the action of this movement between the dampening distributor roller 8A and the dampening forme roller 9A. One of the characteristics of the invention is to make the rubber-covered water take-up roller 94 follow the dampening distributor roller 8A in its axial movement to enable the unit to operate. This axial displacement of the rubber-covered water take-up roller 94 is achieved by equipping the stub axle 50 FIG. 3 of the dampening distributor roller 8 A FIG. 7 View B with a steel disc 99 opposite which the shaft 100 of the rubber-covered water take-up roller 94 carries a polyamide disc 101 with a central groove in which the steel disc 99 engages. The bearings 94A are fixed on to the side members 96 and each contain a ball race 94B accommodating the rotational and axial movement of the shaft 100 fixed in the rubber-covered water take-up roller 94 which corresponds in length to the dampening distributor roller 8A.

The third example shown in illustration of the possibilities of the invention employs the same mechanisms as those used in the first example but with the variations summarized below.

The dampening distributor roller 8B FIG. 8 and the water take-up roller 4C are not copper covered but hard chrome plated or covered with a high-polished micro-porous ceramic. The drying roller 4D and transfer rollers 66A and 63A are covered with rubber of known hydrophilic properties. The dampening forme roller 9A and liaison roller 82 remain identical to those in the first example. One of the characteristics of the invention, in certain forms, is the use, for the purpose of refining regulation of the quantity of water taken up from the trough, of the original mechanism of the press acting as an alternative means of taking up a certain quantity of water by means of the water take-up roller 4 FIG. 3. This mechanism employs a half clutch 28 to drive the shaft of the water take-up roller 4 in periodic rotation variable in amplitude and adjustable with precision. In this configuration, the original water take-up roller 4 is replaced with a regulating roller 4D FIG. 8 equipped with a similar half clutch so as to be subjected to the same method of drive transmitted by friction through the water take-up roller 4C. The action of the regulating roller 4D makes it possible to take up a film of water of even thickness by means of the transfer roller 66A driven at the speed of the press, a function not performed by the original unit, which does not regulate the quantity of water taken up. These two slightly porous rollers store a small quantity of water in their pores and at the tangent points between them and the dampening distributor roller 8B where the continuous film is formed. This arrangement differs from the first example in that the touch between the regulating roller 4B and the transfer roller 66A is extremely light, of the order of one millimetre, to enable slip to occur at the tangent point of the latter two rollers turning at different relative speeds.

The fourth example, like the third, operates by dampening the printing plate by mean of a continuous film of water and includes remote controlled water film regulation by means of a motor 102 FIG. 9 driving the water take-up roller 4C and regulating roller 4D at different and variable speeds with respect to the other rollers which turn at the speed of the press. Two side elements 103 support the motor assembly and are fixed to the cross-member 97 of the press by means of the clamping lugs 98. This assembly is supported on the body of the press by the base plate 104 equipped with a height adjuster in the form of the threaded rod 105. Adjustment of the height of the motor assembly determines the pressure exerted by the water take-up roller 4C against the regulator roller 4D. The synchronous belt 106 transmits the movement to the gear train driving the different rollers.

These few examples, which do not constitute an exhaustive list, make it possible to understand the object of the invention and the advantages which these conversions offer. The printer is enabled, at modest expense, to improve the quality of his printing very considerably while at the same time gaining ease of use and a substantial increase in productivity. These improvements open a wide field of possibilities for this procedure.

Any of these conversions can be incorporated directly during manufacture of the press at even lower cost.

What is claimed is:

1. An improved offset printing press comprising:

a frame;

a printing plate cylinder rotatably mounted to the frame;

a water supply mounted to the frame;

a water take-up roller rotatably mounted to the frame and in communication with the water supply;

a dampening distributor roller rotatably mounted to the frame;

a dampening forme roller rotatably mounted to the frame and being in rolling contact with and positioned between the dampening distributor roller and the printing plate cylinder;

an ink distributor roller rotatably mounted to the frame, an ink forme roller rotatably mounted to the frame and being in rolling contact with and positioned between the ink distributor roller and the plate cylinder;

a dampening unit detachably mounted to the frame and including a regulator roller, a transfer roller, and a liaison roller, each of which are rotatably mounted on the dampening unit, wherein the regulator roller is in selective rolling contact with and positioned between the water take up roller and the transfer roller, wherein the transfer roller is in rolling contact with and positioned between the regulator roller and the dampening distributor roller and the transfer roller is in rolling contact with and positioned between the liaison roller and the regulator roller;

wherein the liaison roller is positioned between the ink forme roller and the transfer roller and is in rolling contact with the transfer roller and in selective rolling contact with the ink forme roller.

2. The printing press of claim 1 and further comprising:

a water regulating roller rotatably mounted to the frame and disposed between and in rolling contact with the regulator roller and the water take-up roller, wherein the water regulating roller and the regulator roller rotate at different relative speeds and are positioned relative to each other at a predetermined distance to permit an outer surface of each of the respective water regulating roller and regulator roller to slip at the point of rolling contact between the respective rollers.

3. The printing press of claim 2 and further comprising:

a motor and a gear assembly mounted to the frame, wherein the gear assembly is in rolling contact with the water take-up roller and wherein the motor and the gear assembly are capable of causing rotation of the water take-up roller and the water regulating roller at a first speed independent of and different than a second speed of rotation of the regulator roller, transfer roller, and liaison roller, and printing plate cylinder.

4. A method of converting an offset printing press dampening unit from alternating feed to a continuous feed system comprising:

providing an offset printing press including:

a frame;

a printing plate cylinder rotatably mounted to the frame;

a water supply mounted to the frame;

a water take-up roller rotatably mounted to the frame and in communication with the water supply;

a dampening distributor roller rotatably mounted to the frame and spaced from the water take-up roller;

a dampening forme roller rotatably mounted to the frame and being in rolling contact with and positioned between the dampening distributor roller and the printing plate cylinder;

an ink distributor roller rotatably mounted to the frame, and an ink forme roller rotatably mounted to the frame and being in rolling contact with and positioned between the ink distributor roller and the plate cylinder, the ink forme roller being spaced from the dampening distributor roller and the dampening forme roller;

a water duct roller rotatably mounted on a pivoting arm pivotally connected to the frame, the water duct roller capable of being in a first position in rolling contact with the water take-up roller and in a second position in rolling contact with the dampening distributor roller;

removing the water duct roller and associated pivoting arm from the frame; and detachably mounting a dampening module to the frame, the dampening module including a regulator roller, a transfer roller, and a liaison roller, each of which are rotatably mounted on the dampening module, the dampening module being configured and arranged so that when mounted on the frame, the regulator roller is in selective rolling contact with and positioned between the water take up roller and the transfer roller, the transfer roller is in rolling contact with and positioned between the regulator roller and the dampening distributor roller, and the transfer roller is in rolling contact with and positioned between the liaison roller and the regulator roller, and the liaison roller is positioned between the ink forme roller and the transfer roller, and is in rolling contact with the tranfer roller and is in selective rolling contact with the ink forme roller.

5. The method of claim 4 wherein the step of detachably mounting the dampening unit further includes the liaison roller being movable between a first position in rolling contact with the ink forme roller and a second position free from rolling contact with the ink forme roller.

6. The method of claim 4 wherein the step of detachably mounting further comprises:

removing a pair of spaced apart bearings mounted on the frame at a first location and upon which the water duct roller is rotatably mounted and separating the bearings from the water duct roller;

mounting a pair of centering elements to the frame in the first location to replace the pair of bearings wherein a lower portion of the dampening unit is supported on the frame by the centering elements; and mounting an upper portion of the dampening unit on the frame of the printing press to prevent rotation of the dampening module.

7. The method of claim 4 wherein the water take-up roller, liaison roller and dampening distributor roller are made from at least one of a copper material and a plastic material.

8. The method of claim 4 and further including replacing the dampening forme roller with a second dampening forme roller having an outer surface formed of hard rubber having a Shore D hardness of 66.

9. The method of claim 4 and further including replacing the water take-up roller and dampening distributor roller with a second water-take up roller and a second dampening distributor roller, respectively, having outer surfaces having oleophilic and hydrophylic properties and the regulator roller and the transfer roller having outer surfaces made of rubber to permit dampening the printing plate cylinder with a continuous film of at least one of water and a water and ink emulsion.

10. An improved offset printing press comprising:

a frame;

a printing plate cylinder rotatably mounted to the frame;

a water supply mounted to the frame;

a water take-up roller rotatably mounted to the frame on a first axle and in communication with the water supply, the water take-up roller having an outer surface made of rubber;

a dampening distributor roller rotatably mounted to the frame on a second axle and in rolling contact with the water take-up roller;

a dampening forme roller rotatably mounted to the frame and being in rolling contact with and positioned between the dampening distributor roller and the printing plate cylinder;

a water duct roller rotatably mounted to the frame and in rolling contact with the dampening distributor roller;

an ink distributor roller rotatably mounted to the frame;

an ink forme roller rotatably mounted to the frame and being in rolling contact with and positioned between the ink distributor roller and the plate cylinder;

a lateral tracking mechanism including a steel disc mounted on the second axle of the dampening distributor roller and a polyamide disc mounted on the first axle of the water take-up roller, the polyamide disc having a groove formed about its periphery, wherein an outer edge of the the steel disc and the groove of the polyamide disc are cooperatively engaged to cause the water take-up roller to track lateral movement of the dampening distributor roller.

11. A dampening add-on unit for mounting in an offset printing press, the offset printing press having a printing plate cylinder rotatably mounted to a main frame and having an ink roller mechanism and a dampening roller mechanism in rolling contact with the printing plate cylinder, and a water take-up roller mechanism that cooperates with the dampening roller mechanism, the dampening add-on unit comprising:

a unit frame detachably mountable to the main frame of the printing press; and a regulator roller, a transfer roller, and a liaison roller, each of which are rotatably mounted on the unit frame in series in a side-by-side relationship so that the transfer roller is in rolling contact with and positioned between the liaison roller and the regulator roller;

wherein upon mounting the unit frame to the main frame in the offest printing press, the dampening add-on unit is so disposed and arranged within the offset printing press so that the liaison roller of the dampening add-on unit is positioned between the ink roller mechanism of the offset printing press and the transfer roller of the dampening add-on unit so that the liaison roller of the dampening add-on unit is selectively in rolling contact with the ink roller mechanism of the offset printing press, the regulator roller of the dampening add-on unit is positioned between the water take-up roller of the offset printing press and the transfer roller of the dampening add-on unit so that the regulator roller of the dampening add-on unit is selectively in rolling contact with the water take-up roller of the offset printing press, and the transfer roller of the dampening add-on unit is positioned adjacent and in selective rolling contact with the dampening roller mechanism of the offset printing press.

* * * * *

UNITED STATES PATENT AND TRADEMARK OFFICE

CERTIFICATE OF CORRECTION

PATENT NO. : 5,816,150

DATED : OCTOBER 6, 1998

INVENTOR(S) : JEAN LUCIEN SARDA

It is certified that error appears in the above-identified patent and that said Letters Patent is hereby corrected as shown below:

Col. 5, line 26, delete "applied..", insert --applied.--

Col. 10, line 8, delete "or it the dampening", insert --or if the dampening--

Signed and Sealed this

Twentieth Day of February, 2001

*Attest:*

Nicholas P. Godici

NICHOLAS P. GODICI

*Attesting Officer*

*Acting Director of the United States Patent and Trademark Office*